US009047740B2

(12) United States Patent
Owen et al.

(10) Patent No.: US 9,047,740 B2
(45) Date of Patent: Jun. 2, 2015

(54) WAGERING GAME, REEL-BASED GAMING MACHINE AND METHOD WITH ANTICIPATION LIGHTING

(75) Inventors: Clint Owen, Rockdale, TX (US); Allison Hyden, Austin, TX (US)

(73) Assignee: Multimedia Games, Inc., Austin, TX (US)

( * ) Notice: Subject to any disclaimer, the term of this patent is extended or adjusted under 35 U.S.C. 154(b) by 139 days.

(21) Appl. No.: 13/182,394

(22) Filed: Jul. 13, 2011

(65) Prior Publication Data

US 2012/0034967 A1 Feb. 9, 2012

Related U.S. Application Data

(60) Provisional application No. 61/371,558, filed on Aug. 6, 2010.

(51) Int. Cl.

| | |
|---|---|
| ***A63F 9/00*** | (2006.01) |
| ***G07F 17/34*** | (2006.01) |
| ***G07F 17/32*** | (2006.01) |

(52) U.S. Cl.

CPC ..... *G07F 17/34* (2013.01); *G07F 17/3211* (2013.01)

(58) Field of Classification Search

None

See application file for complete search history.

(56) References Cited

U.S. PATENT DOCUMENTS

| | | | | |
|---|---|---|---|---|
| 5,018,737 | A | 5/1991 | Okada | |
| 5,934,672 | A | 8/1999 | Sines et al. | |
| 6,206,781 | B1 * | 3/2001 | Sunaga et al. | 463/20 |
| 6,270,408 | B1 * | 8/2001 | Sakamoto et al. | 463/20 |
| 6,315,289 | B1 * | 11/2001 | Sakamoto et al. | 273/121 B |
| 6,811,273 | B2 * | 11/2004 | Satoh et al. | 362/27 |
| 6,902,481 | B2 | 6/2005 | Breckner et al. | |
| 7,219,893 | B2 * | 5/2007 | Tanimura et al. | 273/143 R |
| 7,380,791 | B2 * | 6/2008 | Gauselmann et al. | 273/142 B |
| 7,892,094 | B2 * | 2/2011 | Tanimura et al. | 463/31 |
| 7,972,206 | B2 * | 7/2011 | Okada | 463/16 |
| 8,313,369 | B2 * | 11/2012 | Acres | 463/22 |
| 2003/0017865 | A1 * | 1/2003 | Beaulieu et al. | 463/16 |
| 2003/0087690 | A1 * | 5/2003 | Loose et al. | 463/20 |
| 2004/0062025 | A1 * | 4/2004 | Satoh et al. | 362/27 |
| 2004/0132522 | A1 * | 7/2004 | Seelig et al. | 463/16 |
| 2004/0198485 | A1 * | 10/2004 | Loose et al. | 463/20 |
| 2005/0255907 | A1 * | 11/2005 | Gauselmann et al. | 463/20 |
| 2007/0060295 | A1 * | 3/2007 | DeMar et al. | 463/20 |
| 2007/0238510 | A1 | 10/2007 | Halprin | |
| 2008/0032767 | A1 * | 2/2008 | Okada | 463/20 |
| 2008/0096655 | A1 * | 4/2008 | Rasmussen et al. | 463/31 |

(Continued)

OTHER PUBLICATIONS

PCT, International Search Report dated Jan. 10, 2012, in PCT application serial No. PCT/US11/46309 (2 pages).

(Continued)

*Primary Examiner* — Seng H Lim

(74) *Attorney, Agent, or Firm* — Russell D. Culbertson, Esq.; JP Cody, Esq.

(57) ABSTRACT

A wagering game is operable on a reel-based gaming machine which has the capability to selectively illuminate one or more reels with one or more colors of graduating intensity. In conjunction with the stopping sequence of the reels for a given play of the wagering game, the gaming machine provides a distinctive lighting effect at one or more of the reels when a reel in the set is stopped showing a predefined symbol. The predefined symbol presents the possibility of some desirable outcome for the given play of the wagering game depending upon the positions in which the remaining reels in the set stop.

19 Claims, 11 Drawing Sheets

(56) References Cited

U.S. PATENT DOCUMENTS

| | | | | |
|---|---|---|---|---|
| 2008/0200246 | A1* | 8/2008 | Anderson | 463/31 |
| 2009/0036195 | A1* | 2/2009 | Stewart et al. | 463/20 |
| 2009/0131145 | A1 | 5/2009 | Aoki et al. | |
| 2009/0143134 | A1* | 6/2009 | Anderson et al. | 463/20 |
| 2009/0149242 | A1* | 6/2009 | Woodard et al. | 463/21 |
| 2009/0275382 | A1 | 11/2009 | Vallejo et al. | |
| 2009/0291739 | A1 | 11/2009 | Tsukahara | |
| 2011/0065492 | A1* | 3/2011 | Acres | 463/20 |
| 2012/0115566 | A1* | 5/2012 | Fujisawa et al. | 463/20 |
| 2012/0295689 | A1* | 11/2012 | Owen et al. | 463/20 |

OTHER PUBLICATIONS

PCT, Written Opinion of the International Search Authority dated Jan. 10, 2012, in PCT application serial No. PCT/US11/46309 (7 pages).

* cited by examiner

WAGERING GAME, REEL-BASED GAMING MACHINE AND METHOD WITH ANTICIPATION LIGHTING

CROSS-REFERENCE TO RELATED APPLICATION

The Applicants claim the benefit, under 35 U.S.C. §119(e), of U.S. Provisional Patent Application No. 61/371,558 filed Aug. 6, 2010, and entitled "Wagering Game, Reel-Based Gaming Machine and Method With Anticipation Lighting." The entire content of this provisional application is incorporated herein by this reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the U.S. Patent and Trademark Office patent files or records, but otherwise reserves all rights of copyright whatsoever.

BACKGROUND OF THE INVENTION

1. Field of the Invention

This invention relates to wagering games, gaming machines, gaming systems, and associated methods. More particularly, the invention relates to reel-based gaming machines and related methods presenting wagering games together with anticipatory lighting, sounds, and reel rotation.

2. Description of the Related Art

Various gaming machines have been developed to provide wagering games and present game results. Also, designers have included lights, sounds, and video to generate player interest and excitement. There continues to be a need for innovative methods and gaming machines presenting wagering games in different ways to generate player interest and excitement.

SUMMARY OF THE INVENTION

An embodiment of the present invention includes a wagering game operable on a reel-based gaming machine wherein the reel display cavity includes a lighting structure positioned about each of the reels to selectively illuminate one or more reels with one or more colors of graduating intensity in conjunction with the stopping sequence of the reels and the display of one or more special symbols and/or a designated potential game outcome. The wagering game may further include anticipatory sound effects and controlled slowdown of one or more remaining reels following the display of the special symbols and/or designated potential game outcomes. Once the game outcome is determined, and upon the occurrence of a designated game outcome, the reel lighting may illuminate all the reels with a special lighting and/or the gaming machine may produce special audio/visual effects.

Another embodiment of the present invention is directed to a mechanical reel-based gaming machine with a reel display cavity including mechanical reels, light shields positioned between adjacent reels and vertically disposed with respect to the display surface to reduce or eliminate light splashing, and, RGB lights positioned in RGB (red-green-blue) clusters about each of the reels and which are programmable to individually illuminate and to operate under the control of the gaming processor during gaming execution.

Another embodiment of the present invention is directed to a method of operating a game including the steps of selectively illuminating one or more reels with one or more colors of varying intensity, while sequentially bringing each of the spinning reels to a resting position. The selective illumination in this embodiment is performed in conjunction with a potential outcome.

These and other advantages and features of the invention will be apparent from the following description of preferred embodiments, considered along with the accompanying drawings.

DESCRIPTION OF ILLUSTRATIVE EMBODIMENTS

Figure 1:
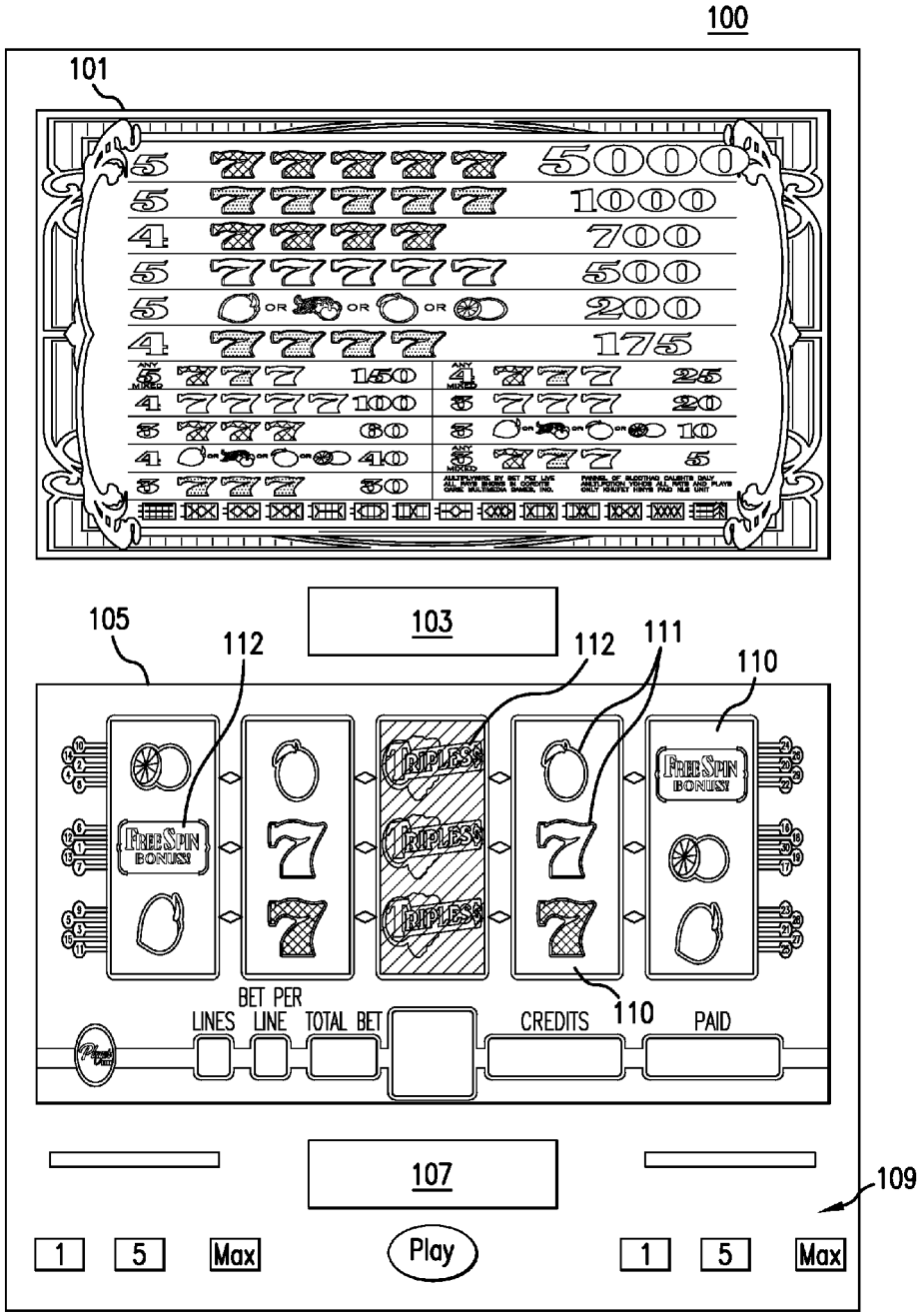
FIG. 1 illustrates an example display arrangement on the front of a gaming machine in accordance with one or more embodiments.

Referring to FIG. 1, an example front set of displays including top glass display 101, middle display 103, primary display 105, and lower display 107 and user interface 109 of gaming machine 100 are shown in accordance with one or more embodiments of the invention. Primary display 105 in this example includes a set of video or mechanical reels 110 bearing reel symbols 111 are spun to present a game outcome after the wagering game has been initiated with a wager by a patron. During the course of the game presentation, the individual reels 110 may be illuminated with one or more different colors and intensities depending upon an impending outcome. In the illustrated example, the third or middle reel 110 is illuminated red (as indicated by the cross-hatching of the middle reel in FIG. 1) while the other reels are illuminated white (indicated by the lack of cross-hatching for the other reels). The reels 110 are ultimately brought to rest to display an arrangement of symbols 111 corresponding to a random or pseudo-random game outcome, and an award is paid depending upon the game outcome. Thus, an effect for reel games, particularly mechanical reel-based games, includes changing individual reel lighting, such as red-green-blue (RGB) lighting, to indicate or signal a potential or achieved event based on displayed individual and collective reel outcomes during a game. For example, in combination with a significant potential game outcome, one or more reels 110 may gradually transition respectively from one color to another during the reel stop sequence and indicate or signal a possible winning outcome, such as a high value award, bonus game or free spin outcome, which may alert a player and increase user anticipation or excitement of the final outcome.

Each of the reels 110 may be illuminated while spinning, for example, the reels may initially be illuminated by white colored lights. The reels 110 may be brought to rest at different times so that the outcome of the stationary reels may be viewed by the wagering patron and interested bystanders while awaiting the outcome of the remaining spinning reels. In this way, potential outcomes may be determined before the final result of the play is shown. Wagering patrons and observers participating with the game may thus enjoy a sense of anticipation and excitement while awaiting the final outcome. This anticipation and excitement may further be stimulated by slowing one or more of the reels 110 that are still spinning prior to finally bringing them to rest.

Additionally, the light color illumination of one or more of the reels 110 may be changed after the reels have been stopped for a given play. For example, if the reels that have been brought to rest display a special or a potentially high reward symbol 112, then the symbol or reel may be illuminated with a red color and there may be a further anticipatory sound emitted. As additional reels 110 come to rest, and if additional special or potentially high reward symbols 112 appear on one of the paylines, then those reels may also be illuminated with a red color and the anticipatory sound may continue to be emitted. In addition, as two or more reels 110 display a potentially high reward outcome, the light, color and sound may increase in intensity for those reels. Additionally, one or more remaining reels 110 may be illuminated with a different color, such as a green color illumination, and the spin of the reels may be slowed in anticipation of a possible impending winning outcome. The spin rate of the last remaining reels 110 may have different speeds as they come to rest prior to the last reel.

Further example lighting indicator configurations in accordance with one or more embodiments may include that during game play, the reels may be illuminated with front lighting and/or backlighting. For example, during game play, each of the reels may be backlit with dim (such as 10% illumination) white lighting and front lit with full (for example, 100% illumination) white lighting. When a win occurs on one or more paylines, each reel may be backlit with dim illumination and front lit with full illumination white lighting. Overriding the dim backlight instruction, symbols on each winning payline may be illuminated with dim-to-full intensity flashing backlight illumination. The flashing light effect may be alternated from one winning payline to another. Each symbol on a corresponding payline may flash synchronously. When award payments or crediting are being made, the reels may simply be lit with dim backlighting and the front lighting may be turned off. The front lighting is turned fully on (100% intensity) when a player makes a request to cash out or initiates another game by placing a wager. In special cases as discussed herein, the white lighting of the reels may be overridden with special colored lighting associated with special events, awards or symbols.

Figure 2:
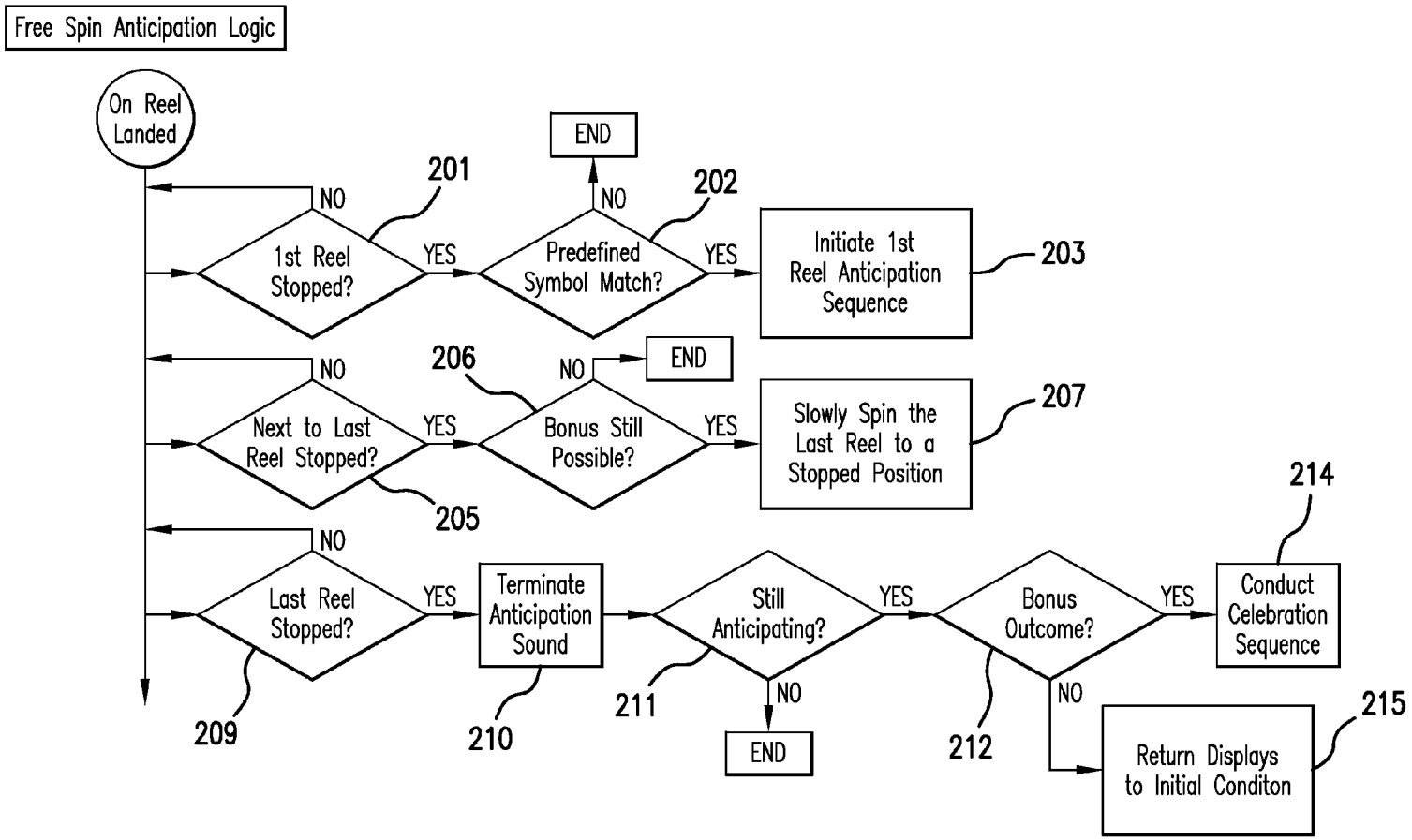
FIG. 2 illustrates an example flowchart of lighting operation logic during a wagering game in accordance with one or more embodiments.

Referring to FIG. 2, an example flowchart of the operation of a wagering game is shown in accordance with one or more embodiments of the present invention. In these embodiments, a set of symbols may be sequentially displayed in a set of display locations in accordance with the game outcome. If an impending or actual special event is triggered during the display sequence, a set of steps are initiated to modify the visual effect of one or more of the display locations and/or modify the rate of displaying symbols in one or more of the remaining display locations. In conjunction with modifying the visual effects associated with the individual display locations, an audio or audio-visual effect may be performed. The set of display locations may correspond to a set of reels such as those shown at primary display area 105 in FIG. 1.

The example shown in FIG. 2 follows the sequence in which the various reel symbol positions are displayed in the operation of the wagering game. In the operation of the wagering game for this example, a number of reels are initially rotated simultaneously. Once a first reel is stopped as determined at decision block 201, it is then determined whether a symbol in a displayed location on that first reel matches a predefined symbol. This symbol matching determination is shown at decision block 202. If there is a match with the predefined symbol, the process proceeds to a first reel anticipation sequence as shown at process block 203. Such a first reel anticipation sequence may include, for example, producing a certain lighting condition at the first reel (which may be a fade in or low intensity, such as 10% intensity, light), delaying the stopping time for the last reel, generating an anticipation sound at the gaming machine, or fading additional reel or other lighting in on the reel display or an associated display, or any combination of these effects.

As shown at decision block 205 in FIG. 2, once the next to the last reel has stopped to show the result conveying symbols for that reel, the process proceeds to determining if a bonus outcome is still possible. This determination is shown at decision block 206, and includes determining if a bonus outcome potentially available by the presence of the predefined symbol detected at decision block 202 is still possible given the symbols now showing after the next to last reel has stopped and perhaps other reels between the first and next to last reels have stopped. If such a bonus outcome is still possible, the process proceeds to the step at process block 207, slowly decreasing the spinning rate of the last reel until reaching a stopped position. If the inquiry at decision block 206 indicates that a bonus outcome is not possible, the anticipation logic process ends and the reel lighting which may have been changed according to the process at block 203, may revert back to a standard lighting condition.

Once the last reel has stopped as indicated by a positive outcome at decision block 209, the example process shown in FIG. 2 terminates the anticipation sound as indicated at process block 210. As shown at decision block 211, it is then determined whether the play is still qualified for a bonus outcome. If the outcome at decision block 211 is positive, it is determined whether a symbol showing on the last reel is a predefined symbol. This inquiry shown at decision block 212 is to determine if the symbol(s) on the last reel, when considered with the remainder of the symbols shown on the earlier stopped reels, produces a bonus outcome which was indicated as being possible in view of the symbol or symbols showing on the first stopped reel, and which triggered the first reel anticipation sequence at block 203. With a positive outcome at decision block 212, the process continues to generate a celebration sequence at the gaming machine as shown at process block 214. This celebration sequence may include producing certain celebratory lighting effects at or around the reels or at some other display at the gaming machine, displaying a celebratory video at a suitable video display at the gaming machine, or generating a celebratory audio output, or a combination of any of these effects. Along with the various celebratory audio and/or video and/or lighting effects at the gaming machine, the celebration sequence or an associated process may include paying an award for the outcome and/or providing a feature game at the gaming machine. If the result of the inquiry at decision block 212 is negative, then the anticipation effects which have previously been produced according to the process are discontinued and the gaming machine display is returned to the initial condition as indicated at process block 215.

It should be noted that if the inquiry at decision block 202, 206, or 211 is negative, then the anticipation logic sequence ends at that point. Ending the sequence in response to a negative outcome at block 202 may include no change in the lighting at the gaming machine. However, ending the anticipation logic sequence at blocks 206 or 211, that is, after the first reel anticipation sequence is initiated, may require terminating the aspects of the anticipation sequence which have already been performed. For example, lighting which has been changed as part of the first reel anticipation sequence may revert back to the regular lighting at the gaming machine if the result at block 206 or block 211 is negative.

It will be appreciated that the various logical steps shown in FIG. 2 may be conducted somewhat out of the order shown in the figure. For example, the determination shown at process block 202 may be performed prior to the time that the first reel stops. This alternative could occur in a gaming machine in which the result for a play at the gaming machine is produced separately from the reels and the reels are stopped to show that separately determined result. For example, the result for a given play may be produced using a random number generator, or produced from a bingo game or a lottery game, and then the reels may be controlled to stop showing symbols consistent with that earlier determined result.

It should also be appreciated that the first reel, next to last reel, and last reel noted in FIG. 2 need not be in any particular physical order. That is, the first reel to stop need not be the left most or right most reel in the reel display, but may be any reel defined as the reel which stops first for a given play. For example, in a reel display including five reels aligned along a common rotational axis, the middle reel may be defined as the reel which stops first on a given play.

In another example implementation, a collection of virtual light layers may be generated and stored in software, such that the virtual light layers may correspond to selective illumination of one or more reels through light fixtures, such as clusters of RGB (red-green-blue) LEDs (light emitting diodes) oriented in one or more locations about each reel. During game play, one or more of the virtual light layers may be selected and utilized sequentially or collectively to illuminate a set of reels in conjunction with the wagering game, such as when one or more reel symbols indicate a potentially impending or actual occurrence of a special event or award. The steps of generating virtual light layers, grouping, and storing in software may be performed prior to execution of a game program on a game processor. Additionally, each time the game updates, the virtual light layers may be merged according to the rules set by each game highlight effect and, if necessary, the light bar may be updated to reflect the new changes.

In one example, each highlight in the game may be linked (such as through a call or read in a subroutine or function pulling in one or more members of the stored set of virtual light layers) to trigger the game processor to execute one or more control instructions causing operation of the light bar in accordance with a set of virtual light layers associated with the particular game highlight and one or more reels. For instance, one game highlight may include the appearance of a special symbol, such as a stacked dragon, on a first reel and the highlight may be linked to activation of a low level (for example, 10% intensity) green or red color light illumination onto the first reel while the remaining reels continue to spin. Thereafter, if the special symbol combines with the appearance of symbols on one or more additional reels which result in a predefined award or trigger a bonus (or feature) game, the highlight may be linked to activation of a high intensity (full 100% intensity) green or red color light illumination onto all the reels, and this light intensity may remain while the award is paid or while the bonus or feature game or games are presented.

Referring to FIG. 3A-3D, example screenshot reel display 301 which may be associated with a gaming machine, such as gaming machine 500 (FIG. 5), includes a bonus highlight effect wherein the appearance of a bonus symbol on one or more reels triggers illumination of those reels with enhanced lighting in accordance with one or more embodiments. For example, reel display 301 may include a set of five (5) reels 302-306 wherein a bonus highlight effect is associated with a bonus symbol on (or displayable in association with) the first, third, and fifth reels (reels 302, 304, and 306) that may trigger a bonus or feature game. During play of the game and following spinning of the reels and stopping of the first, second and third reels, if the bonus symbol appears on the first and third reels, reels 302 and 304, the first and third reels may be illuminated by a low intensity (fade in) green light illumination while the remaining reels are spinning, indicating (or signaling) a possible bonus game trigger or winning combination. In addition to the light illumination signal, a sound may be emitted to further indicate (or signal) and increase awareness (or anticipation) of a possible favorable game result, and, the spinning of the fifth reel may gradually reduce until it comes (or is brought) slowly to a stop under the control of a game processor. Once the fifth reel comes to rest, and if the bonus symbol is displayed, then the bonus game is triggered and all the reels may be illuminated by a full green light illumination. A celebratory audio or audio-visual presentation may also be produced, and any award payment may be credited to the player or the player's account. Either or both of the full intensity green light illumination and celebratory performance may continue during play of any bonus games or round. If the bonus is not triggered, then the green light illumination is turned off and the light illumination of the reels may return to a standard lighting, such as white.

Figure 3A:
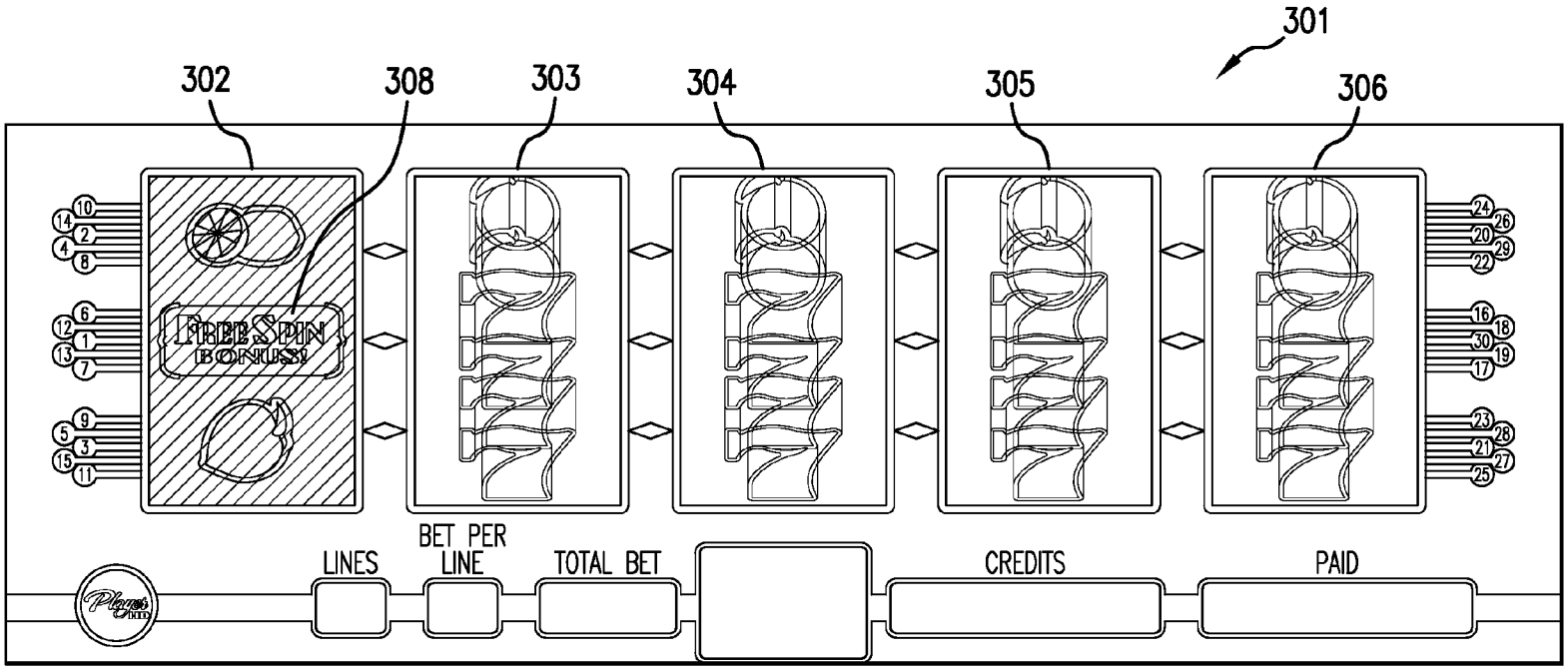
FIG. 3A illustrates an example reel display screenshot which includes a bonus highlight effect triggered by the appearance of a bonus symbol on the first reel and a possible bonus according to one or more embodiments.
Figure 3B:
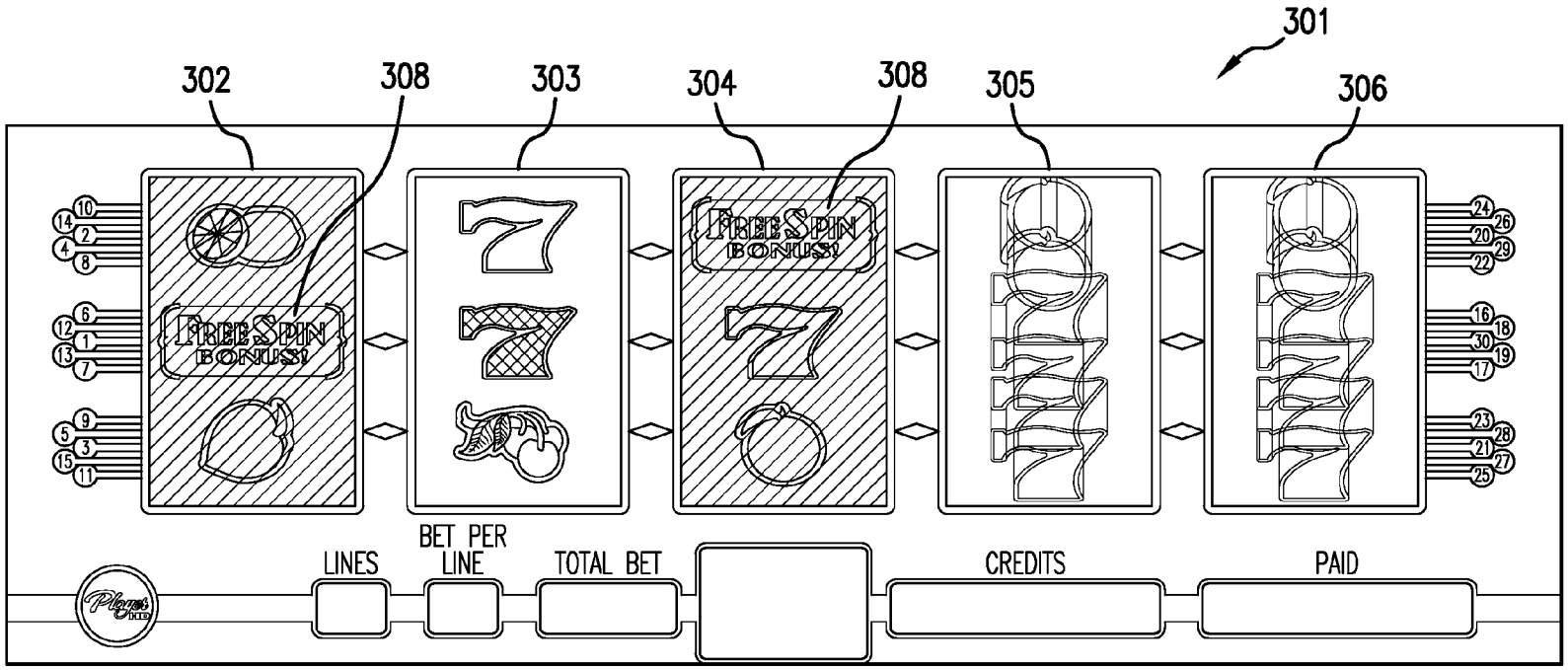
FIG. 3B illustrates an example reel display screenshot which includes a bonus highlight effect triggered by the appearance of a bonus symbol on the first and third reel and a possible bonus according to one or more embodiments.
Figure 3C:
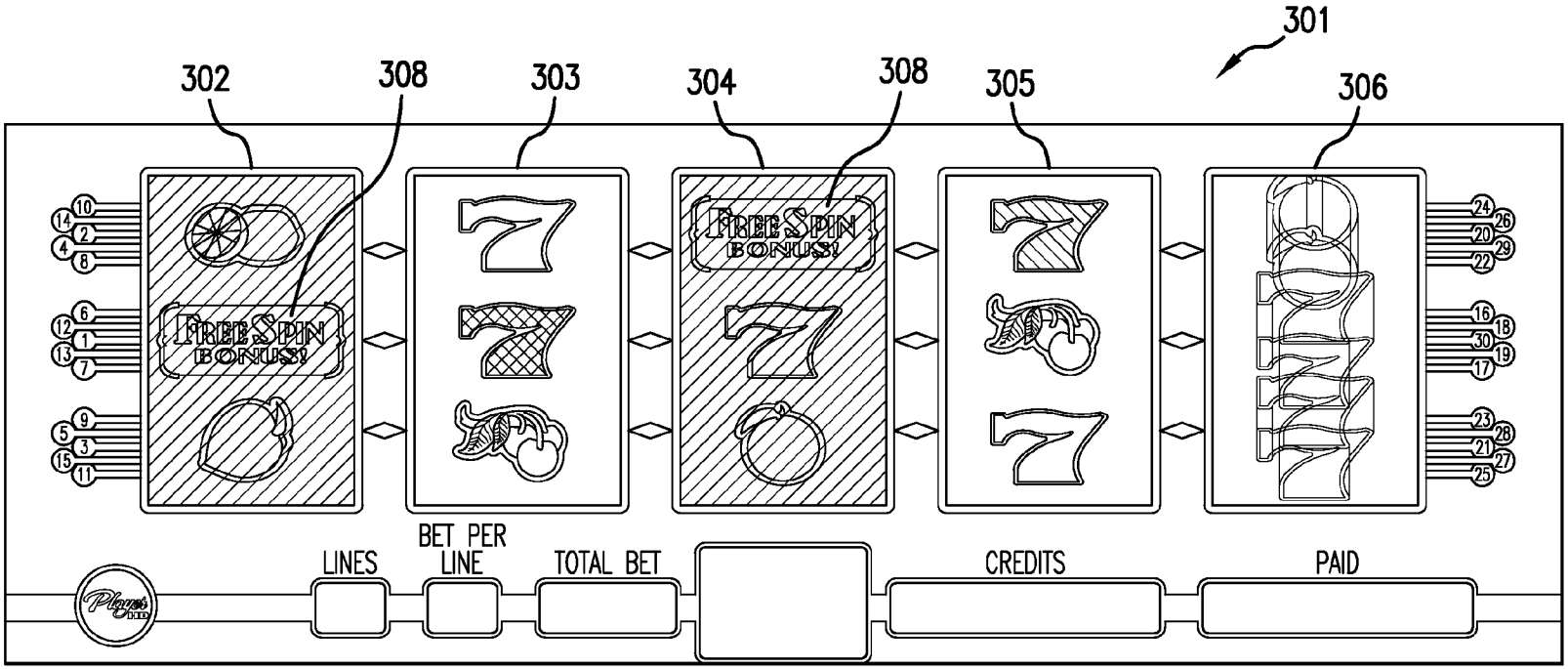
FIG. 3C illustrates an example reel display screenshot which includes a bonus highlight effect triggered by the appearance of a bonus symbol on the first and third reel and a possible bonus symbol on the fifth reel triggering a bonus according to one or more embodiments.

One or more example embodiments of a wagering game with a special symbol may incorporate a free spin bonus symbol 308 (such as shown in FIG. 3A-3D) as a special symbol. When a free spin bonus symbol lands in a position that could possibly trigger a free spin bonus, as shown by symbol 308 in FIG. 3A, the front lighting of the associated reel (free spin symbol reel, reel 302 in FIG. 3A) may illuminate the associated reel with a special lighting (such as a full green) illumination and a special audio (or audio-visual) performance may occur. The special illumination on reel 302 is represented in FIG. 3A by cross-hatching on that reel. After subsequent reels have stopped, and if the bonus cannot be triggered based on the displayed results, the illumination of the free spin symbol reel may be faded by modifying the front light illumination from full green to the standard or base (such as white) lighting color and intensity. For example, if a free spin bonus symbol 308 lands on a first and third reel, 302 and 304, respectively, as shown in FIG. 3B, both reels may be illuminated with a full green lighting effect (indicated by cross-hatching), and, an anticipation sound and/or visual effect may play, while a fourth and fifth reel (reels 305 and 306, respectively, which are shown still spinning in FIG. 3B) are brought to rest to display their outcomes. As shown in FIG. 3C, the fifth reel, reel 306, may be decelerated at a slower pace and be illuminated by front lighting with a fade in green light until the outcome is displayed. If the fifth reel outcome triggers the free spin bonus, then all the reels 302-306 may be illuminated with a full green lighting effect, as indicated by the cross-hatching shown in FIG. 3D. However, if the fifth reel outcome does not trigger the free spin bonus, then the lighting of the respective reels may be faded out from the green color lighting, such that all the reels may be illuminated with a base lighting effect, such as white light illumination.

Figure 3D:
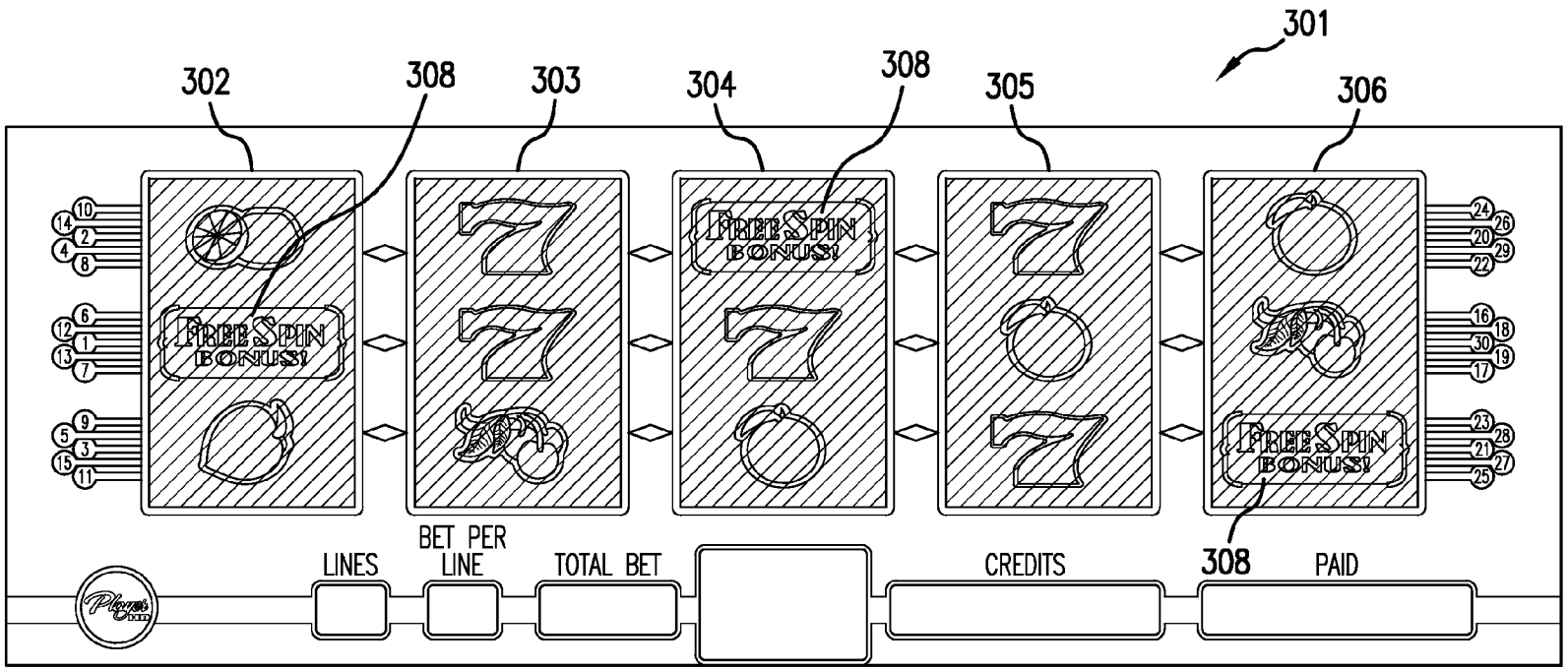
FIG. 3D illustrates an example reel display screenshot which includes a bonus highlight effect triggered by a bonus according to one or more embodiments.

In the case when a free spin bonus is triggered, front lighting may illuminate all the reels with a green lighting effect, as shown in FIG. 3D. When a free spin bonus symbol 308 lands during a free spin bonus game in a position that could possibly retrigger spins, back lighting associated with the symbol location may turn fully on to enhance the illumination of the symbol and special sound and/or audio-visual effects may play. During the free spin bonus game, lighting for stacked wild symbols may be the same as in the base game (described below). Winning paylines in the free spin bonus game may be displayed in the same manner as in the base game except that the front lights may remain full green. When free spin bonus games are retriggered by additional free spin bonus symbols, those symbols may be illuminated with flashing back lighting similar to the display of a winning payline in order to provide additional lighting enhancement.

One or more embodiments of a wagering game may include a special symbol highlight effect associated with a special symbol in accordance with one or more embodiments. For example, during a multi-reel based game, a special symbol may appear on (or be displayed in association with) the first and second reels and trigger a special event or award or be part of the trigger. Such an award may occur as a result of the special symbols occurring anywhere on the display and either on or off the active paylines, such as in the case of a scatter award where the appearance of two special symbols may result in a two symbol scatter award and the appearance of three special symbols may result in a three symbol scatter award. In other special awards or bonuses, after the appearance of two special symbols, a third event may be required to occur in order to trigger the special award or bonus.

During play of the game and following spinning of the reels and stopping of the first and second reels, if the special symbol appears on the first and second reels, then all reels (or simply the reels with the special symbols) may be illuminated by a low intensity (fade in) red color light illumination while any remaining reels continue spinning. If the special event or award is triggered, then all the reels may be illuminated by a high intensity (full) red color light illumination and a celebratory audio or audio-visual presentation may occur along with any award payment credited to the player or the player's account. If the special event is not triggered, then the light illumination of each of the reels reverts to a base illumination, such as white.

Figure 4:
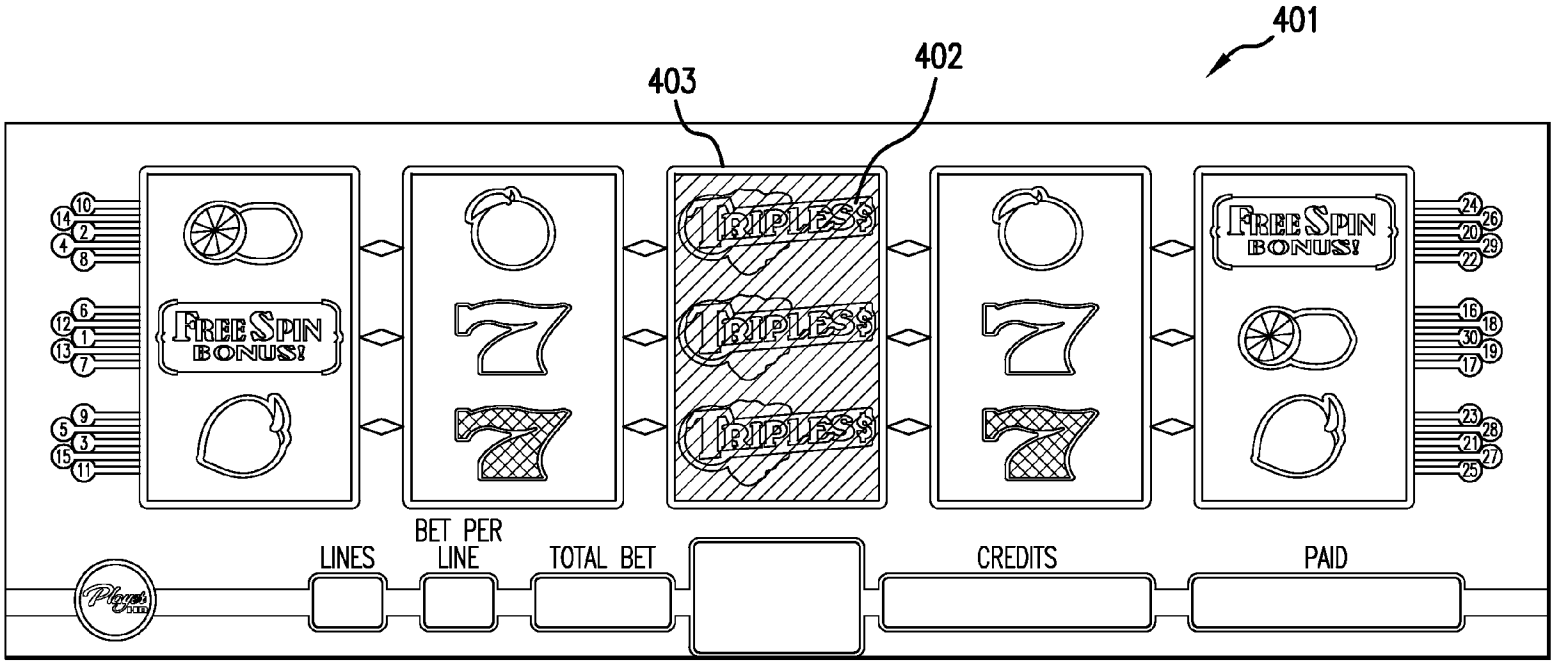
FIG. 4 illustrates an example reel display screenshot which includes a stacked wild symbol highlight effect associated with a stacked wild symbol according to one or more embodiments.

Referring to FIG. 4, example screenshot of reel display 401 which may be associated with a gaming machine, such as gaming machine 500 (FIG. 5), includes a stacked wild symbol highlight effect associated with a stacked wild symbol 402 (a wild symbol extending along a reel and over two or more symbol locations) in accordance with one or more embodiments having a special symbol. (In the example case, the "Triples" stacked wild symbol 402 acts as a wild symbol on any payline and triples the award.) For example, when a stacked wild symbol 402 (or any part thereof) lands on an active payline of a reel (such as the third reel 403 of the 5-reel game shown in FIG. 4), front lighting for the stacked wild symbol reel may change to a full red illumination (indicated by cross-hatching in the figure) and a special audio (or audio-visual) performance may occur. If the wild symbol 402 is part of a winning payline, its behavior may match that of any base game win and the wild symbol reel 403 may remain illuminated with a full red color light illumination until the player makes another wager, initiates another game play or cashes out. If the wild symbol(s) 402 are not part of a winning payline, then the wild symbol reel 403 may be faded from red to a standard (such as white) front and/or back color light illumination corresponding to the other reels.

Figure 5:
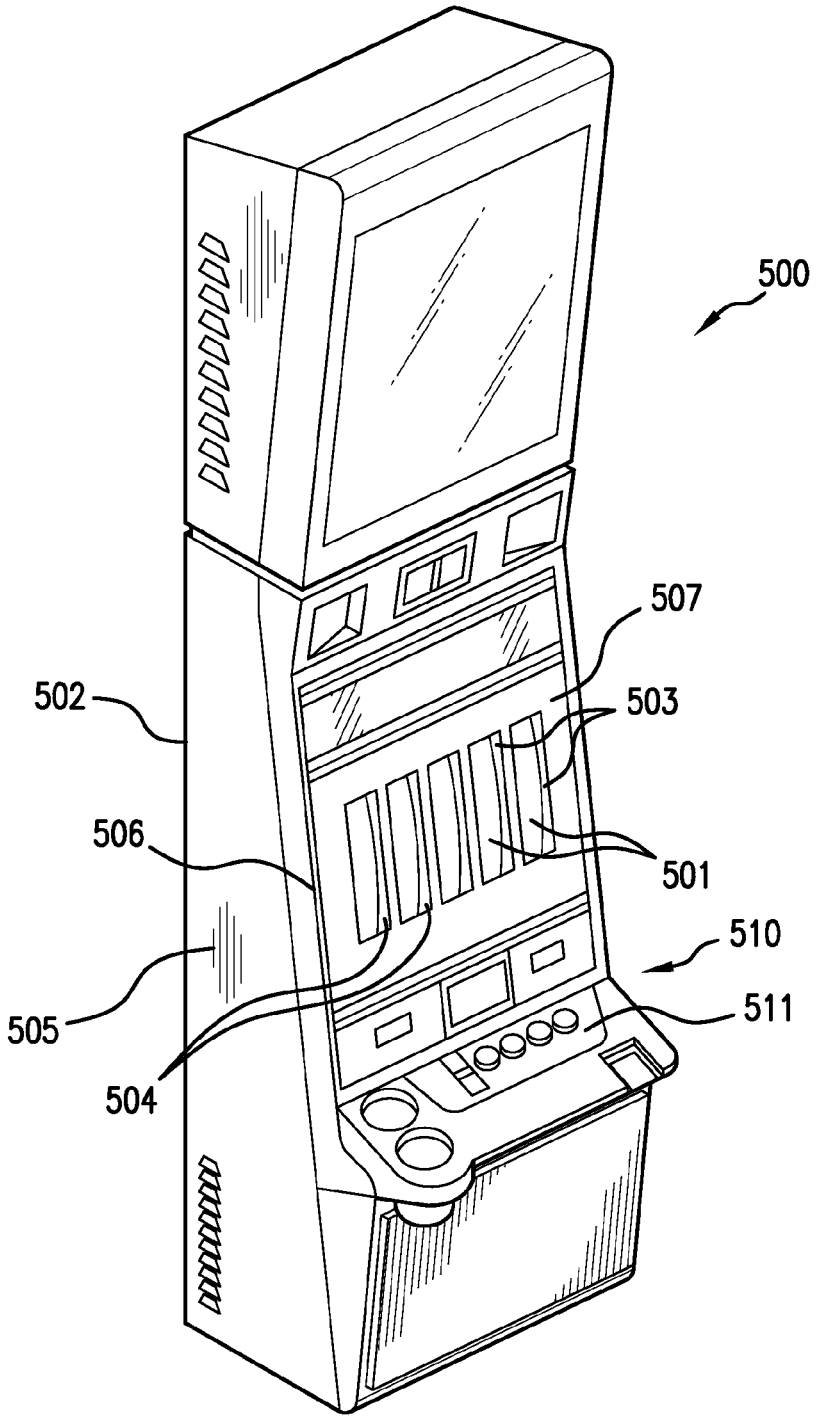
FIG. 5 is a front perspective view of an example gaming machine according to one or more embodiments.

Referring to FIG. 5, gaming machine 500, such as a Multimedia Games™ Mllm_Triples_30L150C gaming machine, is shown having a set of mechanical reels 501, and reel display area 507. Programmable front and rear reel lighting assemblies (not shown in FIG. 5) may be oriented about the reels to illuminate the reel surfaces within the reel display area. Reels 501 in reel display area 507, and the rear reel lighting assemblies are all housed in or about gaming machine cabinet 502 in accordance with one or more embodiments of the invention. While gaming machine 500 is shown as an upright gaming machine cabinet style, various cabinet styles may be utilized including a slant top cabinet style and a bar top cabinet style (where the cabinet may be part of a bar/table top and/or housed therein).

Each reel 501 includes a series of symbols (such as symbols 111 shown in FIG. 1) viewable on or through display panel or windows 503. With the reels 501 in a stationary position, the symbols visible through windows 503 may be viewed as an array of symbols (such as are shown in FIG. 1). During a wagering game, such as may be initiated by a player, the reels 501 may be spun about a respective axle under the control of a game processor which randomly or pseudo-randomly determines the game outcome and causes the reels to stop in accordance with the determined game outcome.

The programmable front and rear lighting assemblies (described further below in connection with FIGS. 6A and 6B) are operable by the game processor in sequence with the gaming machine and game activity, and, may include one or more front and/or rear reel lighting bars with associated lighting modules and/or clusters, such as RGB LEDs. The lighting bars may be horizontally or vertically disposed about each reel 501 and may include clusters of RGB and white LEDs, individually or collectively operable by the game processor, such that the front and/or back light illumination on each reel 501 may be individually controlled by the game processor to separately vary the color and intensity of the lighting associated with each reel portion displayed in display window 503. For example, a fade in lighting affect on an individual reel may be effected by illuminating a first group of one or more RGB light clusters at one or more selected intensities near the lower portion of the display window, subsequently illuminating a second group of one or more clusters at one or more selected intensities near the middle of the window, and subsequent to the second group, illuminating a third group of clusters near the top of the window. Alternatively, the fade in effect may be implemented by illuminating groups from top to bottom of the window area. Different colors may be selected through programming the game together with the desired lighting effects. Back lighting of the reels may be also used to produce additional lighting effects by illuminating RGB clusters located behind each of the reels.

To alleviate splashing of lighting effects of one reel to another reel, reel dividers 504 may be oriented between each of the reels and extend towards display panel 503. Reel dividers 504 may also operate to reflect a portion of the lighting effects, such as by use of a mirrored, white colored, or other reflective surface, and intensify the illumination with lower lighting power levels than would be otherwise achieved without reflection. Reel dividers 504 may comprise a rigid material, such as plastic, which may abut or be adhered to the reel-side of display window 503. In addition or alternatively, reel dividers 504 may be secured as by an upper and/or lower frame extending above and/or below display window 503 and secured to a portion of the interior, such as an inner portion of the front door of gaming machine 500.

One or more paylines, combinations, or patterns of the symbols including those visible through display window 503 may be correlated to a game result payable in accordance with a paytable. Display window 503 may thereby be used to display the game result to one or more patrons standing in front of gaming machine 500. While example gaming machine 500 includes a set of five reels 501, various numbers of reels may be selected or utilized in an implementation of one or more embodiments, such as one, two, three, four, five, six, seven reels, and so forth. Display windows 503 may comprise an area of display surface 507 or may comprise a separate layer thereof. Panel dividers or frames may be painted, etched, etc. onto display surface area 507 to provide a separate viewable area or window 503 for each reel 501. The windows 503 serve to focus attention to the visible portion of the reels 501 and to overlay reel dividers 504 and the space between reels 501.

Alternatively to painting, etching, etc. onto display surface area 507, display surface area 507 may comprise a display panel, such as a flat panel LCD or LED display, which may be programmed to display an opaque frame image except over the display area of reels 501 which may be transparent or translucent during game play of the primary wagering game. In such case, display surface area 507 may be programmed to display a bonus or feature game that may be triggered as discussed above by the appearance of one or more special symbols, and, a touch sensitive panel (such as an overlay of display surface area 507) may be implemented to enable player interactivity, such as to select a displayed button or item, in order to cause the game to perform additional steps and provide one or more bonus or feature game outcomes and awards to the player.

Additionally, while gaming machine 500 is described using mechanical reels with fixed symbols, reels 501 may be implemented using FOLED (flexible organic LED) reel strips or other display types wherein one or more symbols may be programmed dynamically to vary the symbol and/or its appearance; in which case the lighting structure described above may be complemented by programmed video lighting effects displayable on reels 501. Furthermore, one or more display panels may be implemented to present each reel 501 virtually. In the case of virtual displays of the reels, the symbols may be fixed or animated on each of reels 501. Also, overlapping display panels may be implemented to generate video or display effects over reels 501; for example, display windows 503 may be implemented as a transmissive (e.g. Aruze or WMS transmissive display panels) or transparent (e.g. Bally's transparent display panels) display configured to display visual effects together with reels 501 under the control of the game processor during the operation of a wagering game. In the case of virtual reels, the virtual reels may be recessed a distance from display window 503 and segregated by dividers similar to dividers separating mechanical reels, which may provide a spatial characteristic (e.g. IGT's Pure Depth™ display panels); in such case, the lighting and sound effects described above with respect to FIGS. 1-4 may be complemented by programmed video lighting effects of either or both the virtual reels and the overlaying display panel.

In one or more embodiments, the game processor operating the wagering game and controlling game lighting and effects in many instances is implemented as a microprocessor, such as an Intel Pentium™ or Core™ microprocessor, on a printed circuit board including one or more memory devices positioned within gaming machine 500. In alternative implementations, the game processor may be remote from gaming machine 500, such as on a server network connected to gaming machine 500, in which case the game operation as described herein may be accomplished through network communications to control the display of the game on gaming machine 500 including the lighting structure and effects as described above.

Referring further to FIG. 5, gaming machine cabinet 502 comprises a series of enclosure elements including sides 505, a front with front door 506, back, top, and base, so as to define an interior volume. Gaming machine 500 also includes a button panel deck 511, which forms at least a portion of a player interface indicated generally at reference numeral 510. Front door 506 includes display surface area 507 in which a display panel overlays corresponding portions of reels 501. In one or more embodiments, display surface area 507 comprises a sheet of glass on which artwork is silkscreened or otherwise formed, such that the transparent appearing windows 503 are framed for viewing reels 501 and adjacent window frame portions overlay reel dividers 504 that extend towards the back side of the glass whereby the reel dividers act as lighting splash barriers to substantially eliminate or reduce lighting effects directed onto one reel from splashing onto another reel. The position of front door 506 shown in FIG. 5 represents a closed position in which it covers a portion of a front opening of gaming machine cabinet 502. The position of gaming machine 500 shown in FIG. 5 represents an operating position for the gaming machine. It should be noted here that any terms indicating relative position used in this disclosure and the accompanying claims such as "front," "rear," "lateral," "back," and "top," for example, are used with reference to the operating position of gaming machine 500 shown in FIG. 5.

Figure 6A:
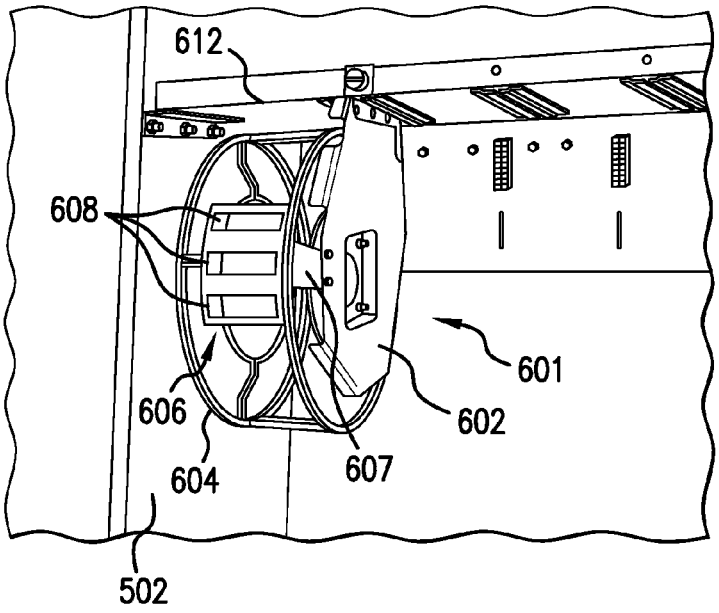
FIG. 6A is a front right side view in perspective of an example reel assembly according to one or more embodiments.
Figure 6B:
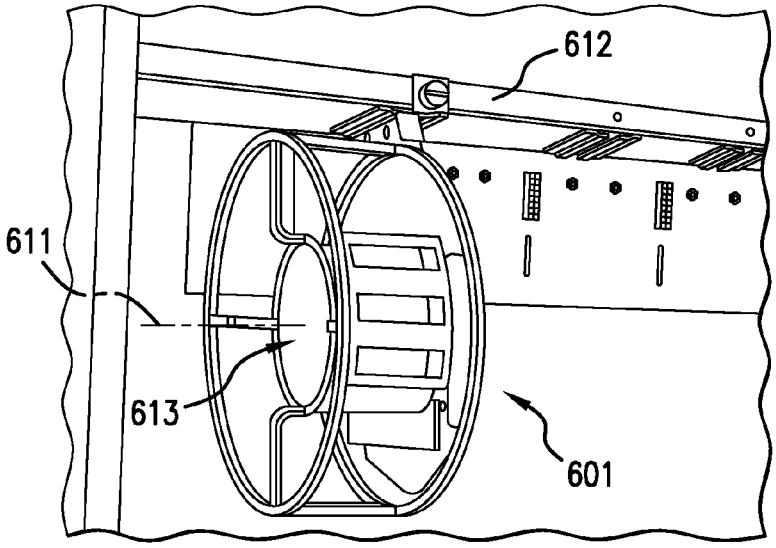
FIG. 6B is a front left side view in perspective of the example reel assembly shown in FIG. 6A.

FIGS. 6A and 6B show an example portion of the interior of the gaming machine cabinet 502 shown in FIG. 5. This portion of the interior of gaming machine cabinet 502 is a portion which would be visible with the front door 506 (shown in FIG. 5) in an open position. Only a single reel assembly 601 is shown in FIGS. 6A and 6B, with the other reel assemblies removed so as to simplify the drawing. Each of the reel assemblies 601 may be supported from a mounting plate 612, which may be supported substantially horizontally in gaming machine cabinet 502 by a suitable supporting arrangement such that a portion of reels 501 may be displayed through viewing windows 503 as shown in FIG. 5. Each reel assembly 601 includes a mounting bracket 602 which ultimately supports a reel superstructure 604. Reel superstructure 604 is adapted to support a reel strip (example portions of which are shown in FIGS. 1, 3-4) which is wrapped around reel superstructure 604 to form a substantially cylindrical shape and on which the reel graphic symbols (such as symbols 111 in FIG. 1) are printed or otherwise formed. Each reel assembly 601 may further include a drive motor 613, such as a stepper motor, operable under the control of the game processor for driving and controlling the reel superstructure 604 and its associated reel strip about a rotational axis shown at 611. An example reel assembly is described more fully together with an example gaming machine cabinet in U.S. Patent Application Publication No. 2008/0119263 A1 published May 22, 2008 (U.S. patent application Ser. No. 11/942,677, filed Nov. 19, 2007). This patent application publication and the corresponding application are hereby incorporated by reference.

Example reel assembly 601 may further include back light assembly 606 which carries a number of lights, such as one or more clusters of RGB LEDs, for backlighting certain areas of the reel strip material mounted on reel superstructure 604. Backlight assembly 606 may be connected to mounting bracket 602 via backlight bracket 607. The electronics and circuitry associated with drive motor 613, backlight assembly 606, and reel assembly 601 may be operable under the control of the game processor.

In one or more embodiments, example backlight assembly 606 may include LED clusters (or other comparably operable light sources) connected to transmit light through each of the three horizontally disposed windows, which in turn are oriented to illuminate a first, second, and third symbol area of the associated reel strip corresponding to the upper, middle, and lower portion of the display window 503 shown in FIG. 5. The backlighting may be triggered as discussed above during operation of the game or during a non-gaming period, such as when the game processor initiates an attract mode. For example, the processor may execute coding that instructs the processor to transmit a signal or signals that causes respective of one or more of the backlight assemblies 606 to: a) illuminate all or a selected number of the backlights of each of the reels at a ten percent white light level after a patron has initiated a wagering game, b) illuminate all or a selected number of the backlights of one reel at a full red light level when a stacked wild symbol appears on a reel during a game in order to illuminate the entire display area of the reel, and/or, c) illuminate a selected number of backlights at a full red light level associated with one of the horizontally disposed windows 608 corresponding to a special symbol appearing in display window 503 in order to illuminate the individual special symbol, such as a 'triple symbol' resulting in a triple award on any associated payline, and/or d) illuminate all or a selected number of the backlights of a first, third, and fifth reel at a full green light level when a bonus free play symbol appears on the corresponding reels during a game in order to illuminate the entire display area of the reel.

In one or more embodiments, an example front light bar assembly (not shown) may be horizontally disposed and attached in a conventional manner to the inner portion of door 506, either above or below display windows 503, and oriented to light the displayed portion of each of the reels with LED clusters (or other comparably operable light sources). The front light bar assembly may comprise a transparent or semi-transparent, tubular, flame-resistant, electrically insulated material, such as a flexible or rigid plastic, with a hollow cavity wherein a string or strings of LEDs may be inserted. Each of the LED clusters may be connected to transmit light onto the front portion of each of the reels 501. The LEDs may be physically clustered or clustered through programming, such that the game processor may control light color and intensity of each of the displayed portion of the reels during the execution of a wagering game program (such as the Triples game shown in the various figures herein).

Figure 7:
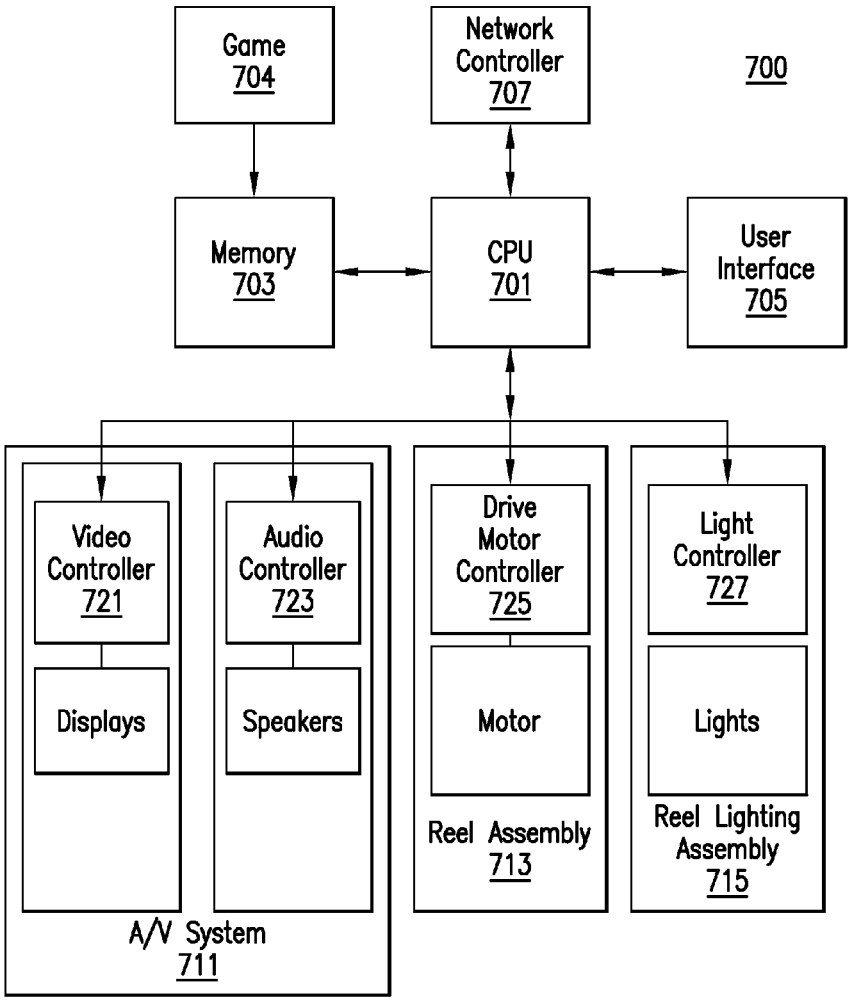
FIG. 7 is a block diagram of an example gaming machine in accordance with one or more embodiments.
Figure 8:
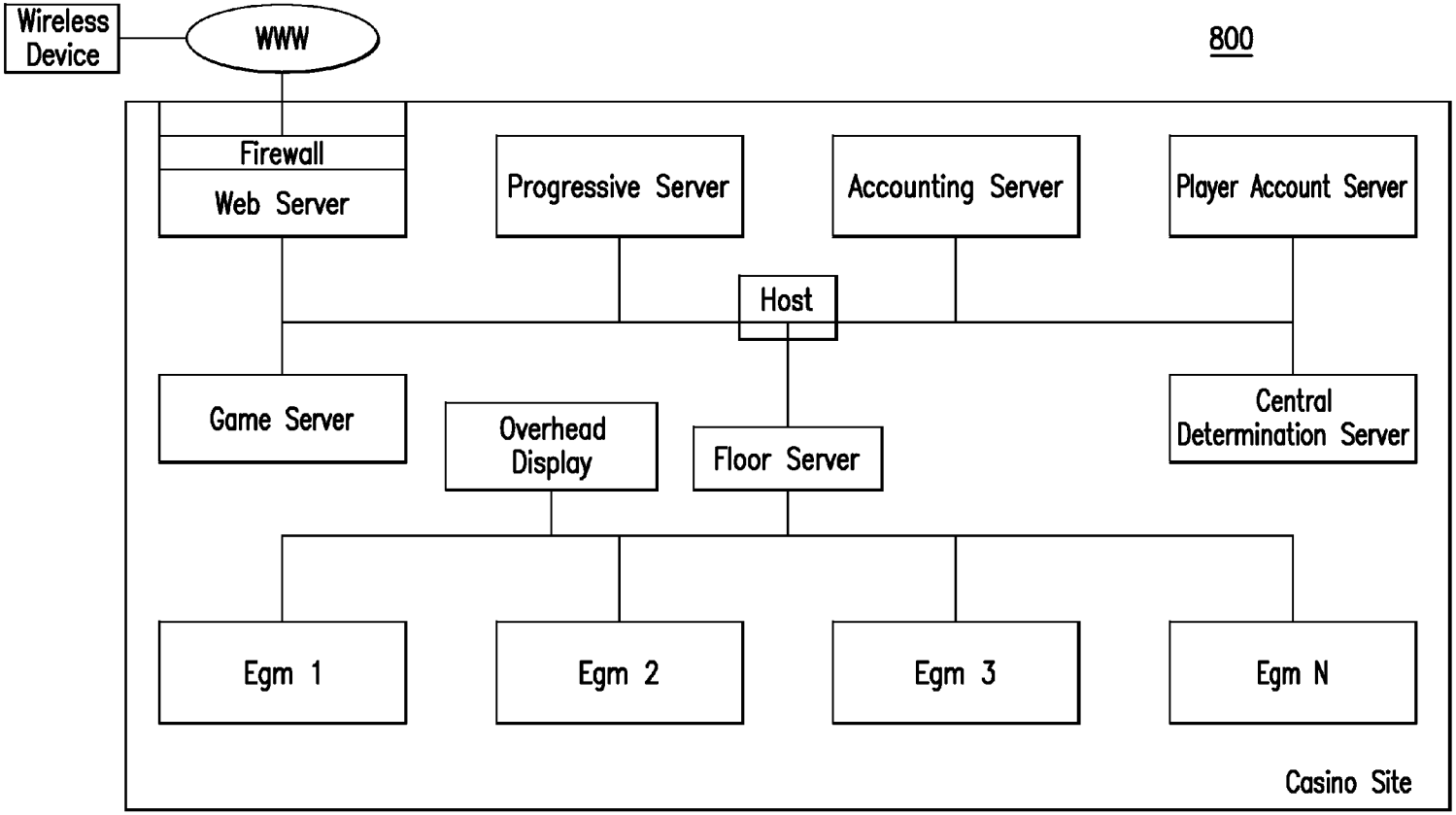
FIG. 8 is a block diagram of an example gaming network in accordance with one or more embodiments.

FIG. 7 shows an example control structure 700 for a gaming machine, such as, gaming machine 500 (FIG. 5), through which embodiments of the present invention may be implemented. Game processor (CPU) 701 may comprise a conventional microprocessor, such as an Intel Pentium™ or Core™ microprocessor, mounted on a printed circuit board with supporting ports, drivers, memory, and coding to communicate with and control gaming machine operations, such as through the execution of coding stored in memory 703 including one or more wagering games 704. Game processor 701 connects to a user interface 705 such as player interface 510 in FIG. 5 through which a player may enter input information and commands. Game processor 701 may respond according to its programming, such as to apply a wager and initiate execution of a game. FIG. 7 also shows a network controller 707 operatively connected to game processor 701. Network controller 707 allows game processor 701 to connect to a network such as the casino server network 800 shown in FIG. 8 which may provide host, remote game play, central determination, progressive, player tracking, and accounting server functionality for the gaming machine 500 and others (EGMs in FIG. 8) similarly connected. Game processor 701 may also connect to various devices within and about the gaming machine including A/V system 711, reel assembly 713, and reel lighting assembly 715 through respective controllers, such as one or more video controller 721, audio controller 723, motor drive circuit controller 725, and light controller 727.

Generally, activity at gaming machine 500 (FIG. 5) may be initiated by a player inserting currency and/or a player card into a bill acceptor and card reader, respectively. Upon insertion, a signal is sent to game processor 701. In the case of the insertion of a player card, the card reader transmits card information which is directed through network controller 707 to a player tracking server connected to the network. The server network transmits player data to gaming machine 500, and, responsive to the data, game processor 701 may execute coding causing player data and commands to be transmitted to one or more of the controllers 721, 723, 725, and 727 instructing the appropriate controller or controllers to display player information on a respective display and possibly issue an audio greeting through one or more speakers. Concurrently, the bill acceptor of the gaming machine 500 sends a signal to game processor 701 which may include an identification of the currency that has been read, and game processor 701 in accordance with its coding may convert the currency amount to credits and transmit a store and display signal to a credit meter and its associated display (for example, the "Credits" display in FIG. 1). Once credits have been associated with the credit meter, the player may select the number of paylines and credits per line that the player wishes to wager, whereupon game processor 701, in accordance with its coding, receives the wager information from user interface 705, transmits accounting and display information to the payline ("Lines"), credits per payline ("Bet per Line), and total bet ("Total Bet") meters and displays, transmits an update to the credit meter and display ("Credits") deducting the amount of the total bet, and initiates the wagering game.

In the case of a Class III gaming devices, when a game is initiated, a random number generator (RNG) is operated by game processor 701 to determine the game outcome. Commonly, game processor 701 is positioned within gaming machine 500 and configured to manage the operation of the gaming machine components, such as shown in FIG. 7; however, the game processor may be either onboard or external to a gaming device played by a player, such as an electronic tablet (e.g. Apple® iPad° or gaming specific tablet), personal data assistant (PDA), cellular telephone (e.g. Blackberry® or) Apple® iPhone®, surface table (e.g. Microsoft®/IGT™ touch sensitive gaming surface table), etc. In such case, when the player places a wager and initiates play of the game through user interface 705 of the gaming device, the game processor may be onboard or remotely located such as within a network gaming server. In the latter case, an onboard microprocessor, controller, or digital signal processor may execute coding to transmit the wager and game request information through the network and the remote game processor may operate an RNG or other process to determine the game outcome.

In the case of Class II gaming devices, the overall structure of the various devices as discussed above is essentially the same with the major difference being the method of determining the game outcome. Commonly, Class II gaming devices utilize the game of bingo as the basis for determining a winning outcome where the ball draw is performed remotely by a network or central determination server (alternative games may be used for determining game outcomes, such as through a lottery drawing of a finite set of numbers, if permitted by the licensing jurisdiction). Class II gaming systems are commonly referred to a central determination systems wherein pools and sub-pools of game outcomes are determined by a central server (or gaming device) and distributed amongst a set of networked gaming devices. The distribution step may be on demand, such as when a gaming device receives a game request, or sets of game outcomes may be distributed to the various networked gaming devices in which case the game processor of the requesting gaming device may select a game outcome from the set of game outcomes, such as by using a RNG or other selection process.

Additionally, Class II gaming devices, such as a bingo-based gaming device, may have multiple displays as shown in FIG. 1 wherein one of the displays (such as display 103 of FIG. 1, for example) may be used to display one or more electronic bingo cards and one or more ball drawings after a game has been initiated in accordance with the game outcome that has been provided to the gaming device by a central determination server. In the case, as in FIGS. 1-6, where the primary display comprises a set of reels, game processor 701 may convert the centrally-determined game outcome to a corresponding value outcome of the reel-based game as shown in FIGS. 1, 3-4 and operates the reel-based game as described above and with respect to those figures.

In one or more embodiments, coding may be implemented and stored in memory 703 and/or 704, executable by game processor 701 to control the reel lighting, speakers, and reels through video, audio, reel drive motor controllers, and lighting controllers 721, 723, 725, 727, respectively. For example, to control the reel lighting, data sets may be programmed and stored, such as by identifying and entering a set of LED clusters. Each cluster may be identified with a data record including an RGB data field to indicate color and light intensity and an LED mask data field to identify the associated LEDs.

An example embodiment is the Multimedia™ CRISPI™ Reel Light assembly incorporated within one or more commercially available Multimedia reel-based gaming machines, such as Triples and Mega Meltdown®. The CRISPI™ Reel light assembly may support six clusters. Each cluster may be defined with an RGB field and an LED mask field. The cluster mask determines which of the masks are active. The CRISPI™ Reel Light may support a pattern with a set of cluster mask states, such as six cluster mask states. Each pattern may be defined by setting a pattern mask and interval. Each cluster may be defined to operate in accordance with its coding by cycling through the active lighting states as may be set in the pattern mask, such as sequentially from state zero to five. During active operation, each cluster may be set to pause for a selected interval, such as twenty milliseconds, in each active state.

For example, as described above with reference to FIGS. 3-4, a front light cluster may be defined to illuminate a first reel with a full green lighting color upon the appearance of a bonus symbol in the displayed symbol outcome and to continue the green lighting illumination for an interval which may extend until a trigger occurs, where the trigger may be: a) subsequent outcome at one or more reels which eliminates the potential special symbol award (such as no bonus symbol appearing on the 3rd or 5th reels), b) the completion of the game including paying any awards, or c) the beginning of a new game. The cluster may further be defined to illuminate the first reel with a full white light depending upon the game state, such as when a new game is initiated, and to maintain the lighting for a period of time following a game, such as one minute.

Referring generally to the forgoing description, as used herein the terms "comprising," "including," "carrying," "having," "containing," "involving," and the like are to be understood to be open-ended, that is, to mean including but not limited to. Any use of ordinal terms such as "first," "second," "third," etc., in the claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The above-described example embodiments are intended to illustrate the principles of the invention, but not to limit the scope of the invention. Various other embodiments and modifications to these preferred embodiments may be made by those skilled in the art without departing from the scope of the present invention. For example, the free play bonus symbols shown in FIGS. 3A-D may be implemented on any of the reels and a free play bonus may be triggered by one, two, three or more of the free play bonus symbols depending upon the rules of the game. In one example, a single free play bonus may trigger a single free spin, a second free play bonus may trigger two free spins, and so forth. Additionally, although the free play bonus was shown in the illustrated example as a scatter pay where it did not matter whether the displayed free play bonus symbols appeared on a payline, other embodiments may require the free play bonus symbols to appear on an active (wagered upon) payline or may provide additional awards for that occurrence.

The described lighting effects may be adjusted to the corresponding locations of the special symbols and be triggered on or off in the same manner as described above. Additionally, while the examples have discussed full (one hundred percent) lighting of the front LEDs and ten percent lighting of the back LEDs, these lighting intensities may be varied depending upon the desired lighting for a selected location. For example, in a lower light facility, it may be more desirable to modify the gaming machine lighting to use lesser intensity than in a more lighted facility. This use of a lower light intensity may be accomplished in various ways including defining the forward cluster data so that the full intensity is less than full (such as ninety percent intensity) and the back lighting clusters provide less than ten percent or greater intensity depending upon the desired effect.

The invention claimed is:

1. A method of operating a wagering game, the method including:

receiving a player input through a user interface at a gaming machine;

responsive to the player input, illuminating a set of reels at the gaming machine with a base lighting effect at a base color and base light intensity from one or more light source clusters located behind and in front of a displayed portion of the reels to place the set of reels in a base lighting state and spinning the reels while in the base lighting state, the set of reels comprising three or more mechanical reels or video-generated reels;

stopping a first reel of the set of reels to display a first reel outcome;

if the first reel outcome includes a first predefined symbol, —illuminating a portion of at least the first reel with an anticipation lighting color different from the base color and at a first light intensity to place the set of reels in a first anticipation lighting state different from the base lighting state, the first light intensity greater than the base light intensity;

after stopping the first reel, stopping a second reel of the set of reels to display a second reel outcome;

if the displayed first and second reel outcomes respectively include the first predefined symbol, illuminating a portion of at least the second reel while a third reel is spinning to place the set of reels in a second anticipation lighting state different from the base lighting state and the first anticipation lighting state;

if the displayed second reel outcome does not include the first predefined symbol, then fading the set of reels from the first anticipation lighting state to the base lighting state; and after each of the reels of the set of reels have been stopped to display a game outcome for the player input, awarding a payment associated with any winning result defined in the game outcome and if the first predefined symbol is not part of a winning combination then fading the set of reels from the second anticipation lighting state to the base lighting state.

2. The method of claim 1 further including, if the displayed first and second reel outcomes respectively include the first predefined symbol, increasing the light intensity of the anticipation lighting color from the first light intensity to a second light intensity.

3. The method of claim 1 wherein illuminating the portion of at least the first reel with the anticipation lighting color at the first light intensity includes accessing a light layer stored in memory accessible by a processing device included with the gaming machine, the light layer comprising a definition of color and intensity for a number of light emitting elements for any one of the reels in the set of reels.

4. The method of claim 1, if the first reel outcome includes the predefined symbol, initiating an anticipation audio effect; and if the displayed first and second reel outcomes respectively include the predefined symbol, modifying the anticipation audio effect from a first audio intensity to a second audio intensity while a third reel is spinning.

5. The method of claim 1 wherein if the game outcome is a predefined outcome type, further including illuminating a portion of at least the third reel to place the set of reels in a third anticipation lighting state different from the base lighting state, first anticipation lighting state, and second anticipation lighting state and maintaining illumination of the reels with the anticipation lighting color during the awarding step.

6. The method of claim 5, the awarding step including awarding a bonus play of the gaming machine when the game outcome comprises a bonus play outcome associated with the third anticipation lighting state;

spinning the set of reels for the bonus play; and illuminating the reels with a bonus play lighting effect during the bonus play to place the set of reels in a bonus play lighting state during the bonus play, the bonus play lighting state being different from the base lighting state.

7. The method of claim 6 further including:

if the displayed outcome for the first reel includes a second predefined symbol, illuminating a portion of the first reel to place the set of reels in a bonus play result anticipation state, the bonus play result anticipation state being different from the first anticipation lighting state and the base lighting state.

8. A gaming machine including:

(a) a display system;

(b) a player input system;

(c) at least one processor; and (d) at least one memory device storing instructions executable by the at least one processor to:

(i) receive a player input for a game through the player input system;

(ii) responsive to the player input, cause the display system to illuminate a set of reels displayed through the display system with a base lighting effect at a base color to place the set of reels in a base lighting state and spin the reels while in the base lighting state, the set of reels comprising three or more mechanical reels or video-generated reels;

(iii) cause the display system to stop a first reel of the set of reels to display a first reel outcome;

(iv) if the first reel outcome includes a first predefined symbol, cause the display system to illuminate a portion of at least the first reel with an anticipation lighting color different from the base color and at a first light intensity to place the set of reels in a first anticipation lighting state different from the base lighting state;

(v) after the first reel is stopped, cause the display system to stop a second reel of the set of reels to display a second reel outcome;

(vi) if the displayed first and second reel outcomes respectively include the first predefined symbol, cause the display system to illuminate a portion of at least the second reel while a third reel is spinning to place the set of reels in a second anticipation lighting state different from the base lighting state and the first anticipation lighting state;

if the displayed second reel outcome does not include the first predefined symbol, then fading the set of reels from the first anticipation lighting state to the base lighting state; and (vii) after each of the reels of the set of reels have been stopped to display a game outcome for the player input, cause a prize to be awarded for the player input if the displayed game outcome is defined as a winning result for the game;

and if the first predefined symbol is not part of a winning combination then fading the set of reels from the second anticipation lighting state to the base lighting state.

9. The gaming machine of claim 8 wherein the instructions are also executable to, if the displayed first and second reel outcomes respectively include the first predefined symbol, cause the display system to increase the first light intensity of the anticipation lighting color to a second light intensity.

10. The gaming machine of claim 8 wherein illuminating the portion of at least the first reel with the anticipation lighting color at the first light intensity includes accessing a light layer stored in memory accessible by a processing device included with the gaming machine, the light layer comprising a definition of color and intensity for a number of light emitting elements for any one of the reels in the set of reels.

11. The gaming machine of claim 8 wherein the instructions are also executable to, if the game outcome is a predefined outcome type, cause the display system to illuminate a portion of at least the third reel to place the set of reels in a third anticipation lighting state different from the base lighting state, the first anticipation lighting state, and the second anticipation lighting state and maintaining illumination of the reels with the anticipation lighting color during the awarding step.

12. The gaming machine of claim 11 wherein the instructions are also executable to:

(a) cause the gaming machine to award a bonus play of the gaming machine when the game outcome comprises a bonus play outcome associated with the third anticipation lighting state;

(b) cause the display system to spin the set of reels for the bonus play; and (c) cause the display system to illuminate the reels with a bonus play lighting effect during the bonus play to place the set of reels in a bonus play lighting state during the bonus play, the bonus play lighting state being different from the base lighting state.

13. The gaming machine of claim 12 wherein the instructions are also executable to, if the displayed outcome for the first reel includes a second predefined symbol, cause the display device to illuminate a portion of the first reel to place the set of reels in a bonus play result anticipation state, the bonus play result anticipation state being different from the first anticipation lighting state and the base lighting state.

14. A program product stored on one or more non-transitory computer readable data storage devices, the program product including:

(a) player interface program code executable for a gaming machine to receive a player input through a user interface at the gaming machine;

(b) reel control program code executable for the gaming machine to, responsive to the player input, spin a set of three or more mechanical or video-generated reels at the gaming machine, and to sequentially stop the set of reels to display a respective outcome for each respective reel such that the set of stopped reels provides an array of reel outcomes representing an outcome for the player input;

(c) reel lighting program code executable for the gaming machine to:

(i) responsive to the player input, illuminate the set of reels with a base lighting effect at a base color to place the set of reels in a base lighting state while all of the reels in the set of reels are spinning;

(ii) if the outcome for a first reel includes a first predefined symbol upon stopping the first reel, illuminate a portion of at least the first reel with an anticipation lighting color different from the base color and at a first light intensity to place the set of reels in a first anticipation lighting state different from the base lighting state;

(iii) if the outcome for a second reel includes the first predefined symbol upon stopping the second reel, illuminate a portion of at least the second reel while a third reel is spinning to place the set of reels in a second anticipation lighting state different from the base lighting state and the first anticipation lighting state;

if the outcome for the second reel does not include the first predefined symbol, then fading the set of reels from the first anticipation lighting state to the base lighting state; and (d) award program code executable to after each of the reels of the set of reels have been stopped to display the game outcome for the player input, cause a prize to be awarded for the player input if the displayed game outcome is defined as a winning result for the game.

15. The program product of claim 14 wherein the reel lighting program code is also executable to, if the displayed first and second reel outcomes respectively include the first predefined symbol, cause the gaming machine to increase the first light intensity of the anticipation lighting color to a second light intensity.

16. The program product of claim 14 wherein illuminating the portion of at least the first reel with the anticipation lighting color at the first light intensity includes accessing a light layer stored in memory accessible by a processing device included with the gaming machine, the light layer comprising a definition of color and intensity for a number of light emitting elements for any one of the reels in the set of reels.

17. The program product of claim 14 wherein the reel lighting program code is also executable to, if the game outcome is a predefined outcome type, cause the gaming machine to illuminate a portion of at least the third reel to place the set of reels in a third anticipation lighting state different from the base lighting state, the first anticipation lighting state, and the second anticipation lighting state and maintaining illumination of the reels with the anticipation lighting color during the awarding step.

18. The program product of claim 17 wherein:

(a) the award program code is also executable to cause the gaming machine to award a bonus play of the gaming machine when the game outcome comprises a bonus play outcome associated with the third anticipation lighting state;

(b) the reel control program code is also executable to spin the set of reels for the bonus play; and (c) the reel lighting program code is also executable to cause the gaming machine to illuminate the reels with a bonus play lighting effect during the bonus play to place the set of reels in a bonus play lighting state during the bonus play, the bonus play lighting state being different from the base lighting state.

19. The program product of claim 18 wherein the reel lighting program code is also executable to, if the displayed outcome for the first reel includes a second predefined symbol, cause the gaming machine to illuminate a portion of the first reel to place the set of reels in a bonus play result anticipation state, the bonus play result anticipation state being different from the first anticipation lighting state and the base lighting state.

* * * * *